US008745816B2

(12) United States Patent
Salvato

(10) Patent No.: US 8,745,816 B2
(45) Date of Patent: Jun. 10, 2014

(54) COMBINATION BROOM VACUUM CLEANING DEVICE

(76) Inventor: Greg Salvato, New Albany, OH (US)

( * ) Notice: Subject to any disclaimer, the term of this patent is extended or adjusted under 35 U.S.C. 154(b) by 130 days.

(21) Appl. No.: 13/414,922

(22) Filed: Mar. 8, 2012

(65) Prior Publication Data

US 2013/0232721 A1 Sep. 12, 2013

(51) Int. Cl.
*A47L 5/00* (2006.01)
*A47L 9/00* (2006.01)

(52) U.S. Cl.
USPC ..... 15/344; 15/339

(58) Field of Classification Search
USPC ..... 15/344, 335, 339
See application file for complete search history.

(56) References Cited

U.S. PATENT DOCUMENTS

| | | | | |
|---|---|---|---|---|
| 1,217,817 | A * | 2/1917 | Peters | 15/335 |
| 1,338,791 | A * | 5/1920 | Replogle | 15/335 |
| 4,519,113 | A * | 5/1985 | Hipple | 15/335 |
| 5,617,610 | A * | 4/1997 | Dearaujo | 15/328 |
| 5,638,572 | A | 6/1997 | Ferrari | |
| 5,722,112 | A | 3/1998 | Scanni et al. | |
| 5,839,158 | A | 11/1998 | Schupp et al. | |
| 6,029,311 | A | 2/2000 | Scanni et al. | |
| 6,079,077 | A * | 6/2000 | Kajihara et al. | 15/332 |
| 6,317,920 | B1 * | 11/2001 | Brickner et al. | 15/334 |
| 6,363,571 | B1 * | 4/2002 | Block et al. | 15/335 |
| 8,015,662 | B2 | 9/2011 | Rosenzweig et al. | |
| 2012/0030897 | A1 * | 2/2012 | Crouch | 15/344 |

FOREIGN PATENT DOCUMENTS

| | | | | |
|---|---|---|---|---|
| JP | 2004008782 A * | 1/2004 | | A47L 9/10 |

OTHER PUBLICATIONS

JP2004008782A (Abstract), 2004.*

* cited by examiner

*Primary Examiner* — Mark Spisich
*Assistant Examiner* — Andrew A Horton
(74) *Attorney, Agent, or Firm* — Standley Law Group LLP

(57) ABSTRACT

A lightweight cleaning device including a vacuum component combined with a broom is described herein. The vacuum is connected to the handle of the broom opposite the bristle portion of the broom. The handle may be inserted into the vacuum or the vacuum may be inserted into the handle portion of the broom. The vacuum may be removably attached to the handle.

5 Claims, 3 Drawing Sheets

COMBINATION BROOM VACUUM CLEANING DEVICE

TECHNICAL FIELD

Exemplary embodiments of the present invention relate to cleaning devices. More particularly, the exemplary embodiments relate to a combined broom vacuum cleaning device.

BACKGROUND

Traditionally, brooms have been used to clean loose debris from flooring. Typically, this practice involves using the broom to sweep the dirt into a concentrated pile and then directing the pile into a dustpan. Although the transfer of dirt to the dustpan can be accomplished by a single individual, it requires the individual to either bend over or squat down to properly position the dustpan. This can prove to be difficult for people with arthritis, back pain, or other ailments, and may prove impossible for the elderly, disabled, or otherwise physically challenged individuals.

Once the dirt is transferred to the dustpan, the dustpan must be carried to a waste receptacle. While in transit, it is easy for dirt to be spilled from the dustpan. In addition, the simple act of carrying the dustpan may result in dirt loss due to the air flow over the dustpan.

Further, dustpans often leave a thin and elusive line of dust and other small particles that can only be removed by hand, sponge, damp cloth or vacuum cleaner. Often a full-sized or hand-held vacuum cleaner may be used. As with the dustpan, this approach requires additional time and physical effort to locate, position, power and use the equipment to apprehend the debris. In most cases, a standard-sized vacuum cleaner is excessive for most light refuse collection and is therefore not optimal from an energy consumption perspective.

There have been attempts at combining a broom and a vacuum; such combinations involve an approach wherein the vacuum portion is housed within or otherwise integrated into the mechanism that sweeps the debris. These designs require that the vacuum cleaner possesses sufficient power to not only remove the debris itself, but must do so at some distance from the debris and must provide suction through the bristles of the sweeping element. This results in devices that are overly complicated and heavy for the average user, and impractical for the elderly or disabled. Consequently, there is a need for a device that combines the simplicity of a broom with the efficiency of a vacuum in a single device that is functional and easily manipulated by a variety of users.

SUMMARY OF THE INVENTIVE CONCEPT

Exemplary embodiments of the inventive concept provides for a lightweight cleaning device including a vacuum component integrated with a common broom. The vacuum component is connected to or housed within the top end of the broom handle opposite the bristle portion of the broom. This embodiment enables efficiency and flexibility in dust collection by simply flipping the handle to the vacuum end and positioning the suction tip sufficiently close to the dust pile. In other exemplary embodiments, the vacuum may be detached from the handle and used independently therefrom. Exemplary embodiments of the invention are designed to ease physical effort and provide increased efficiency in the process of collecting debris. The invention may have embodiments that can be implemented as stand-alone attachments with a standard or custom connector to allow integration with an existing broom handle or as a fully integrated tool with the option to detach the vacuum component from the broom handle.

Some embodiments of the invention include a handle having bristles and a vacuum at opposing ends. The vacuum has an insert portion that extends into the hollow handle. The insert portion may contain the power supply or other parts of the vacuum. The vacuum may be separate and detachable from the handle. In embodiments having a detachable vacuum, a variety of attachment methods may be employed. Some attachments may include mechanical fasteners, sleeves, pressure fittings, adhesives, magnets, clips or combinations thereof.

In other exemplary embodiments, the vacuum may include a depression therein. The depression is adapted to receive the handle into its interior. In this way the vacuum may be used with both hollow and solid handles. Like other embodiments, the vacuum may be detachable and use a variety of attachment methods. It should also be understood that the vacuum may be permanently attached to the handle.

In still other exemplary embodiments, of the inventive concept, the vacuum and the handle may be constructed from a single unit. In this embodiment the shell of the vacuum and the handle may be molded together to have a unitary design.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
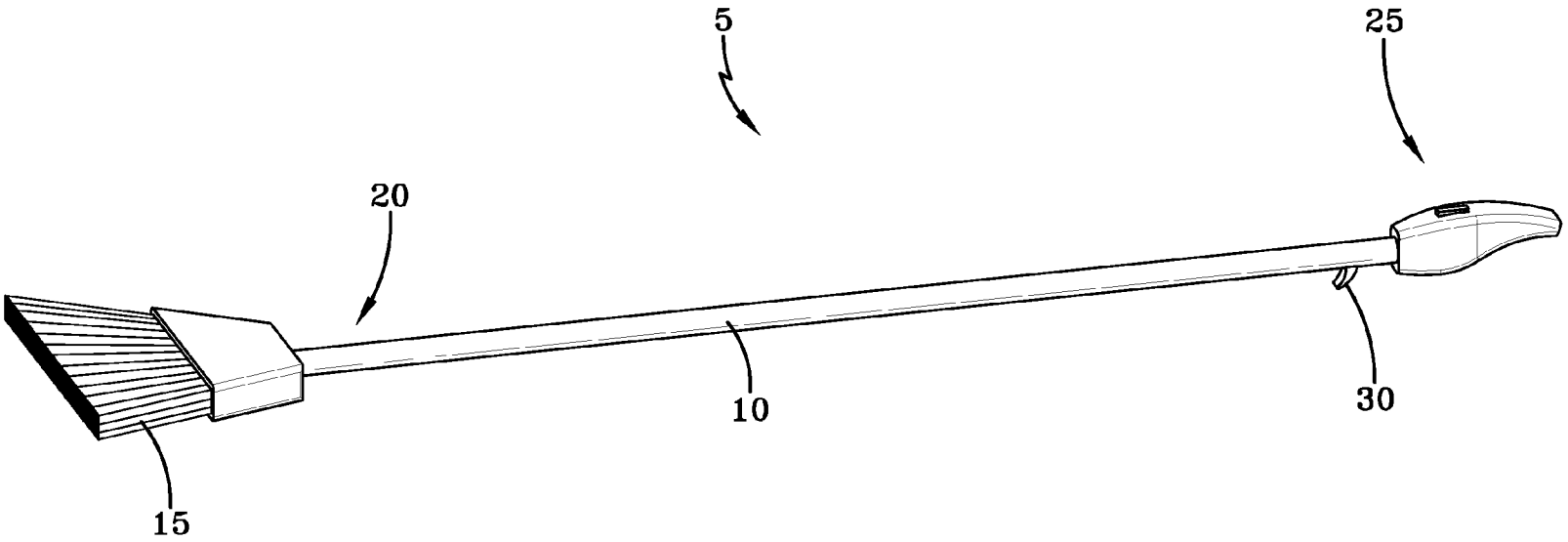
FIG. 1 is an exemplary embodiment of a device combining a broom and a vacuum for the removal of debris according to the inventive concept.

A broom/vacuum combination device 5, according to the inventive concept, is illustrated in FIG. 1. The device 5 includes a handle 10 having bristles 15 at one end thereof forming the broom portion 20 of the device 5. On the end of the handle 10 opposite the bristles 15 is a vacuum portion 25 attached thereto. To facilitate easy storage, the device 5 may have a hook 30, or optional strap, extending from the handle 10 of the device 5 adjacent to the end attached to the vacuum 25. The hook 30 and the optional strap allow the device 5 to be suspended from a wall mount or similar suspension system (not shown in the Figures).

The broom portion 20, including the bristles 15 and the handle 10, can have any configuration typically available. The handle 10 of the device 5 may be either hollow or solid as the vacuum 25 may be affixed to handles having either design. Accordingly, the broom 20 may be any broom currently available and the vacuum 25 may be retro fit onto the handle 10 opposite the bristles 15. Although shown with a conventional broom 20 for home use, one of skill in the art should also understand that the inventive concept also encompasses push brooms and other broom designs.

In some exemplary embodiments, rather than retro fitting the vacuum 25 to an existing handle 10, the handle 10 and the vacuum 25 may be molded together as a single unit. In these embodiments, the end of the handle 10 opposing the vacuum 25 may have a molded bristle portion or the end of the handle 10 may have an attachment means for bristles, such as a threaded portion, mechanical fasteners, adhesives, or other connection elements. In embodiments having a handle 10 molded with the vacuum 25, the vacuum 25 may open to allow access to the power source and to allow the debris to be removed.

Figure 2:
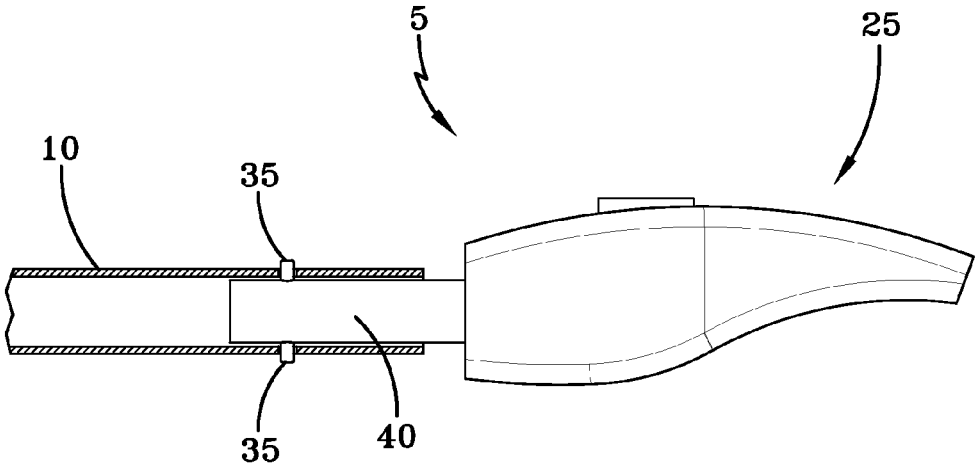
FIG. 2 illustrates an exemplary method of removably attaching a vacuum to a broom handle in accordance with the inventive concept.

In some exemplary embodiments of the device 5, the vacuum 25 is removably attached to the handle 10. This removable attachment can be seen in FIGS. 2 and 3. As shown in FIG. 2, the vacuum 25 is inserted into a hollow handle 10 and is held in place by biased pins 35 extending through the exterior of the handle 10. The pins 35 are biased to extend through holes arranged in the handle 10 preventing movement of the vacuum 25 and the handle 10 relative to one another. In this embodiment, the vacuum 25 can be removed simply by pressing in the biased pins 35 and sliding the vacuum out of the handle 10. The insert portion 40 of the vacuum 25 may be used as a grip for the vacuum 25 separate from the handle 10 and may also be used to house the electrical components of the vacuum 25. This feature can be seen in the cross-sectional view in FIG. 3.

Figure 3:
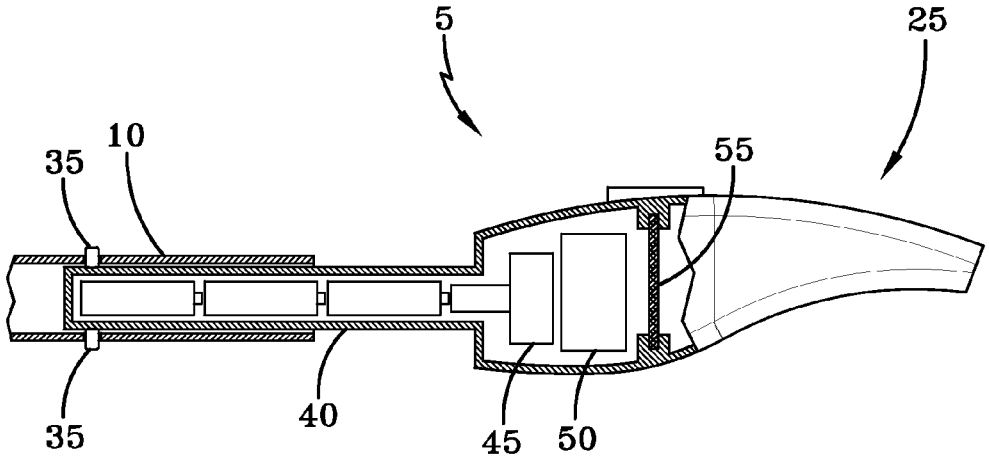
FIG. 3 illustrates another exemplary embodiment of a vacuum removably attached to a broom handle in accordance with the inventive concept.

FIG. 3 is a cross-sectional view of the vacuum 25 end of the device 5. As with the embodiment illustrated in FIG. 2, the vacuum 25 is removably attached to the handle 10 and is locked into position by the biased pins 35. In this embodiment, the power source for the vacuum 25 is located in the insert portion 40 of the vacuum 25. This design decreases the overall size of the device 5 by utilizing the hollow space within the handle 10. As can be seen, the power source powers a fan 45 to provide suction for the vacuum 25. Dirt enters the vacuum 25 and is contained with the collection compartment 50. Various filters 55 or screens may be used with the vacuum. One of ordinary skill should understand that a variety of motors and fans and vacuum configurations could be used in the vacuum 25 of the invention.

It should also be understood that the removable connection between the handle 10 and the vacuum 25 having an insert 40 can be accomplished in a variety of ways. For example, the handle 10 and the insert 40 can be joined using mechanical fasteners, biased pins (as shown in FIGS. 2, 3), pressure fittings, adhesives, thread portions, locking channels, magnets and other similar attachment devices.

Figure 4:
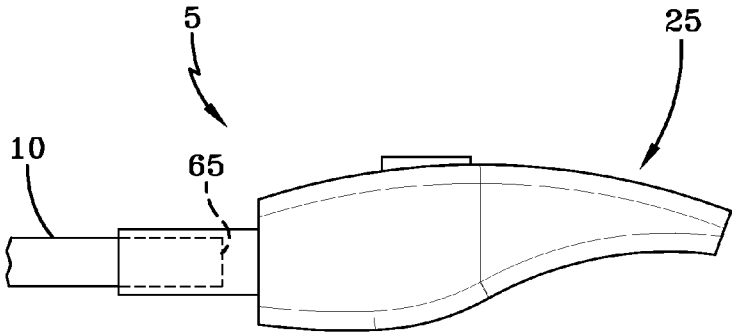
FIG. 4 illustrates another exemplary embodiment of a vacuum removably attached to a broom handle in accordance with the inventive concept.

FIG. 4 illustrates another exemplary embodiment of the inventive concept of the device 5, wherein the handle 10 is inserted into the vacuum 25. The handle 10 is nested into a depression 65 in the vacuum 25; the depression 65 is adapted to receive the handle 10. This embodiment allows the vacuum 25 to be used in conjunction with a solid handle 10. However, it should be understood that both a solid handle 10 and a hollow handle 10 may be inserted into the vacuum 25. The connection between the vacuum 25 and the handle 10 may be facilitated by threaded portions, pressure fittings, compression couplings, mechanical fasteners, adhesives, spring loaded pins, and other similar methods.

It should be understood that the vacuum 25 may be removable from the handle 10 in some exemplary embodiments. This removability of the vacuum 25 allows for easy replacement of batteries and removal of collected dirt. In other exemplary embodiments, the device 5 may have a permanently attached vacuum 25. As with all other exemplary embodiments described herein, the vacuum 25 may be powered by disposable batteries or rechargeable batteries.

Figure 5:
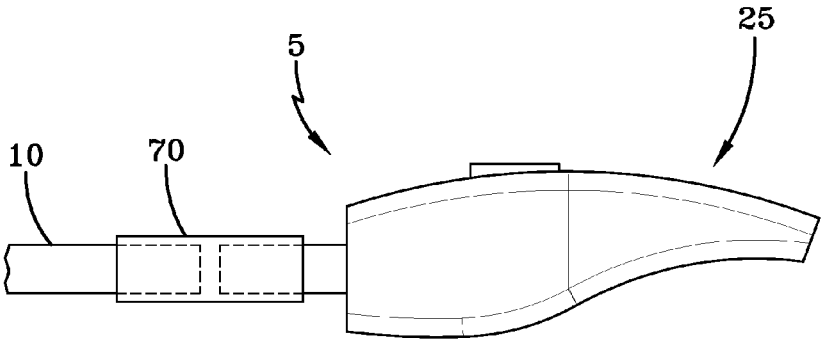
FIG. 5 illustrates an exemplary embodiment of a vacuum removably attached to a broom handle using a sleeve in accordance with the inventive concept.

FIG. 5 illustrates an exemplary embodiment of the inventive concept of the device 5. In this embodiment, the handle 10 and the vacuum 25 abut one another. In order to secure the vacuum 25 to the handle 10, a sleeve 70 that covers both portions of the handle 10 and the vacuum 25 is used. The sleeve 70 is adapted to receive handles 10 and vacuums 25 having different diameters and shapes and secure them to one another. The sleeve 70 can be used with both hollow and solid handles 10. Likewise, the sleeve 70 can be used with vacuums 25 that have either a depression 50 or an insert portion 40. The sleeve 70 may even be used with other embodiments described herein as an additional method of attachment. The sleeve 70 may also be used with existing vacuums 25 designs to attach the vacuum 25 to a broom handle 10.

Figure 6:
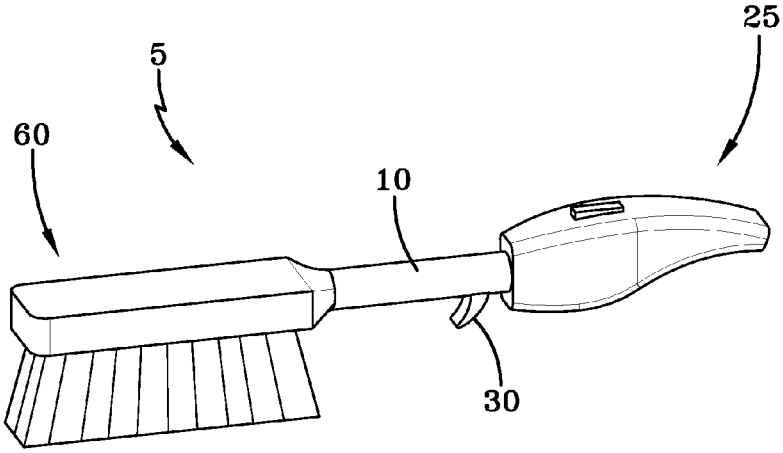
FIG. 6 is an exemplary embodiment of the inventive concept wherein the vacuum is attached to small hand broom.

As stated herein, the vacuum 25 may be attached to a variety of different types of brooms and associated handles 10, such as that illustrated in FIG. 6. The exemplary device 5 in FIG. 6 is a vacuum 25 attached to the handle 10 of a hand broom 60

While certain embodiments of the present invention are described in detail above. The scope of the invention is not to be considered limited by such disclosure, and modifications are possible without departing from the spirit of the invention as evidenced by the following claims:

What is claimed is:

1. A cleaning device comprising:

a handle comprising an elongated rod having a first longitudinal end and a second longitudinal end;

a broom comprising bristles, the broom being attached to the first end of the handle; and a vacuum cleaner having a first longitudinal end, a second longitudinal end, a source of suction, and an attachment portion, the attachment portion being coupled to the second end of the handle and located on the first end of the vacuum cleaner, and the suction nozzle being located on the second end of the vacuum cleaner.

2. The cleaning device of claim 1, wherein said vacuum cleaner is removably coupled to the handle.

3. The cleaning device of claim 2, wherein said vacuum cleaner is coupled to the handle using mechanical fasteners, biased pins, adhesives, magnets, pressure fittings, threaded portions, or sleeves.

4. The cleaning device of claim 1, wherein the attachment portion of the vacuum cleaner is inserted to the second end of the handle.

5. The cleaning device of claim 1, wherein the attachment portion houses a power supply for the vacuum cleaner.

* * * * *